US005906215A

United States Patent [19]

Conroy

[11] Patent Number: 5,906,215

[45] Date of Patent: May 25, 1999

[54] FISHING REEL CLEANING SOLUTION

[75] Inventor: Alan P. Conroy, St. Petersburg, Fla.

[73] Assignee: Reel Clean Corporation, Palm Harbor, Fla.

[21] Appl. No.: 08/975,298

[22] Filed: Nov. 20, 1997

[51] Int. Cl.[6] ..... C23G 5/032; C11D 1/29; C11D 3/43

[52] U.S. Cl. ..... 134/22.1; 134/22.16; 510/365; 510/426; 510/506

[58] Field of Search ..... 510/365, 506, 510/432, 427, 426, 417, 429, 505, 428, 254, 255, 511; 134/22.1, 22.16

[56] References Cited

U.S. PATENT DOCUMENTS 4,518,516 5/1985 Godard et al. .
5,439,610 8/1995 Ryan et al. .
5,456,850 10/1995 Trabitzsch et al. .
5,456,856 10/1995 Flaningam et al. .
5,458,880 10/1995 Kasat et al. .
5,468,303 11/1995 Thomas, Sr. .
5,607,911 3/1997 Levin et al. .

*Primary Examiner*—Kery Fries
*Assistant Examiner*—Gregory E. Webb
*Attorney, Agent, or Firm*—Larson & Larson. P.A.; James E. Larson

[57] ABSTRACT

A cleaning solution for removing salt, rust, old oil and grease from fishing reels employs in combination 2-butoyxethanol, the tetra sodium salt of ethylenediamine tetra acetic acid, sodium metasilicate, sodium laureth sulfate and water. Fishing reel parts are immersed in the solution in an inner container having holes in a bottom surface and enclosed by an outer container. The inner container is removed, the solution flows out and remaining solution is washed from the reel parts with water to leave clean reel parts.

5 Claims, 2 Drawing Sheets

FISHING REEL CLEANING SOLUTION

BACKGROUND OF THE INVENTION

This invention relates to a liquid cleaning bath. More particularly, it refers to an aqueous based solution for cleaning fishing reels.

Aqueous based cleaning solutions are well known in the prior art for cleaning household dishes and the like. Sodium metasilicate is known as a detergent for such solutions. See U.S. Pat. Nos. 4,518,516 and 5,456,850. Tetra sodium salt of ethylenediamine tetra acetic acid is used in aqueous cleaning compositions for carpets, rugs and textiles as in U.S. Pat. No. 5,439,610. It also is used as a rust remover as shown in U.S. Pat. Nos. 5,468,303 and 5,607,911. U.S. Pat. No. 5,456,856 describes a cleaning solution containing 4 to about 18% by weight 2-butoxyethanol. While sodium metasilicate, tetra sodium salt of ethylenediamine tetra acetic acid and 2-butoxyethanol have all been separately used in various cleaning solutions, they have not been combined heretofore in any useful cleaning solution.

Fishing reels, particularly reels used in a salt water environment are subjected to effects from various salts and oils used to lubricate gears and sensitive drag mechanisms. A cleaning solution is needed that will specifically remove rust, salt and old oils and grease from the reel parts so that a clean coating of oil can be applied for maximum reel efficiency. Such a solution must be environmentally compatible and not toxic to the person cleaning the fishing reel.

SUMMARY OF THE INVENTION

I have invented an aqueous cleaning solution that specifically is useful for removing rust, salt and old oil or grease from fishing reels. This solution is non-toxic and environmentally friendly. The cleaning solution contains 1 to 10% by weight 2-butoxyethanol, 0.3–4% by weight tetra sodium salt of ethylenediamine tetra acetic acid, 1.0–5% by weight sodium metasilicate, a surfactant and water. Sodium laureth sulfate at 0.5 to 5.0% by weight is a suitable surfactant.

The fishing reel is disassembled and its parts placed in a double bucket containing the cleaning solution and allowed to soak for about an hour. The inner bucket contains holes in a bottom surface so that when it is lifted out of the exterior bucket the cleaning solution drains from the reel parts. Excess cleaning solution is washed off with water which evaporates from the reel parts prior to reassembly.

SPECIFIC DESCRIPTION OF THE PREFERRED EMBODIMENT

Figure 1:
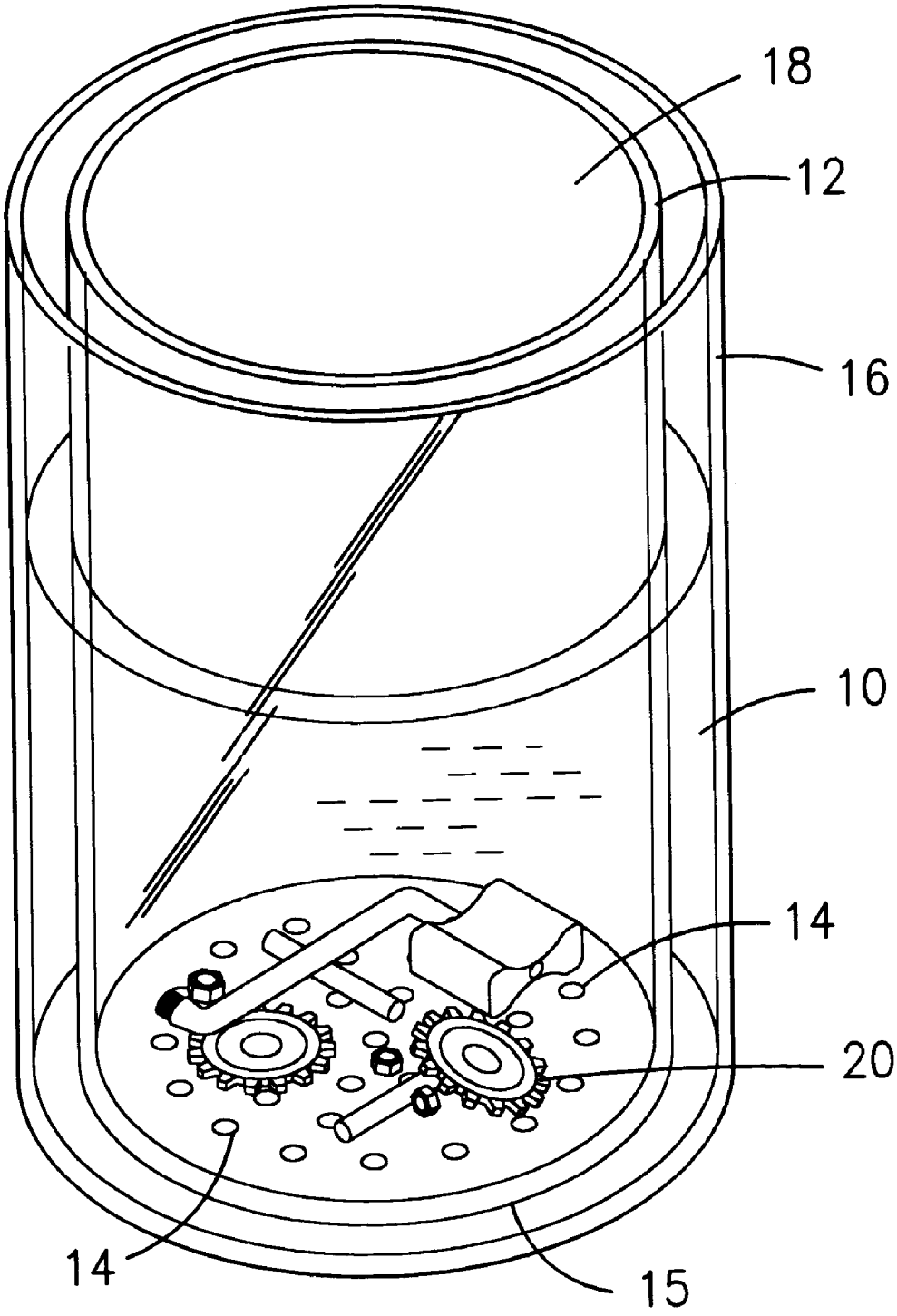
FIG. 1 shows fishing reel parts immersed in a double container in the solution.
Figure 2:
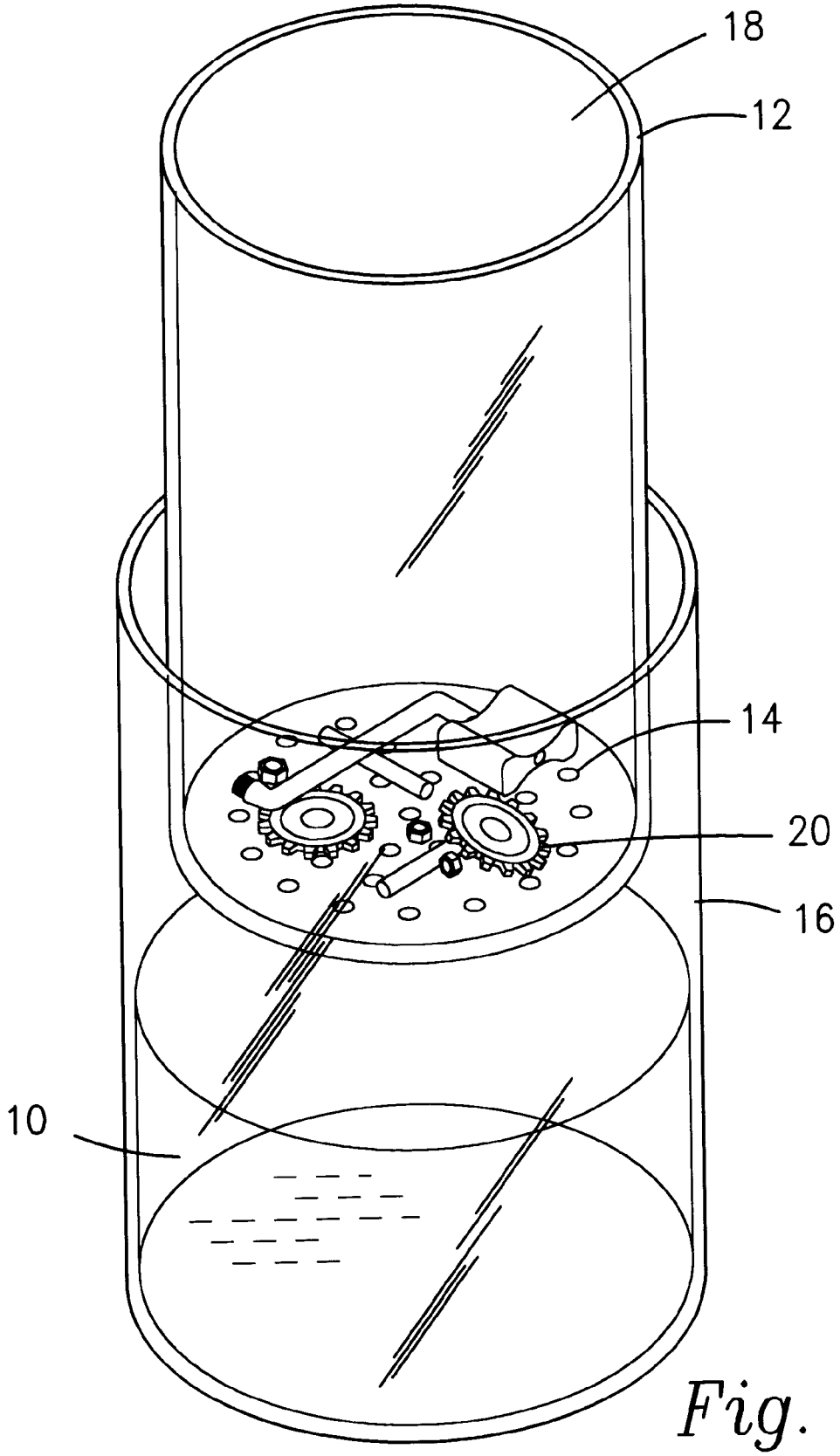
FIG. 2 shows the interior container lifted above the solution level to allow draining solution from the reel parts.

The cleaning solution of this invention is prepared by mixing the following ingredients in the indicated weight percentage.

| | |
|---|---|
| 1–10% | 2-butoxyethanol |
| 0.3–4% | tetra sodium salt of ethylenediamine tetra acetic acid |
| 1.0–5.0% | sodium metasilicate |
| 0.5–5.0% | sodium laureth sulfate |
| Remainder | water. |

A preferred cleaning solution contains:

| | |
|---|---|
| 7.0% | 2-butoxyethanol |
| 2.5% | tetra sodium salt of ethylenediamine tetra acetic acid |
| 3.5% | sodium metasilicate |
| 2.0% | sodium laureth sulfate |
| 85.0% | water. |

Other suitable surfactants can be substituted for the sodium laureth sulfate.

The cleaning solution is environmentally friendly and is non-toxic to the skin of most people.

In use, the solution 10 is placed in an interior container 12 having multiple drainage holes 14 in a bottom surface 15. The exterior container 16 merely has a top opening 18. The fishing reel is disassembled and individual parts 20 are spread out on the bottom surface 15 of interior container 12. The reel parts 20 are allowed to soak in the cleaning solution 10 for about an hour. Thereafter, the interior container 12 is partially lifted out of exterior container 16 so that the cleaning solution 10 can exit through holes 14 in surface 15. Any solution remaining on the reel parts 20 is removed by washing the parts 20 in water and air drying.

The cleaning solution 10 of this invention removes rust, old grease and salts from the fishing reel parts 20 so that fresh grease or oil can be applied and the reel reassembled for continued use in the customary manner.

The containers 12 and 16 can be made of a plastic such as polyethylene or copolymers of ethylene and other compatible organic polymers. In addition, the containers 12 and 16 can be made from a metal such as galvanized steel or aluminum.

The invention may be embodied in other specific forms without departing from the spirit or essential characteristics. All changes which come within the meaning and range of equivalency of the claims are intended to be embraced therein.

Having thus described the invention, what is claimed and desired to be secured by Letters Patent is:

1. A method of cleaning fishing reel parts, comprising disassembling a fishing reel into various parts and immersing the parts in a cleaning solution comprising:

| | | |
|---|---|---|
| 1–10% | by weight | 2-butoxyethanol |
| 0.3–4% | by weight | tetra sodium salt of ethylenediamine tetra acetic acid |
| 1.0–5% | by weight | sodium metasilicate |
| 0.5–5% | by weight | a surfactant |
| 86–97.2% | by weight | water. |

2. The method according to claim 1 wherein the parts are immersed in the cleaning solution containing as the surfactant sodium laureth sulfate.

3. The method according to claim 1 wherein the parts are immersed in the cleaning solution of which the percent by weight amount of each ingredient is:

| | |
|---|---|
| 7.0 | 2-butyoxyethanol |
| 2.5 | tetra sodium salt of ethylenediamine tetra acetic acid |
| 3.5 | sodium metasilicate |
| 2.0 | sodium laureth sulfate |
| 85.0 | water. |

4. A method of cleaning fishing reel parts comprising placing the parts on a bottom surface of an interior container provided with multiple holes on the bottom surface, immersing the interior container into an exterior container containing a cleaning solution for fishing reels consisting essentially of

| | | |
|---|---|---|
| 1–10% | by weight | 2-butoxyethanol, |
| 0.3–4% | by weight | tetra sodium salt of ethylenediamine tetra acetic acid, |
| 1.0–5% | by weight | sodium metasilicate, |
| 0.5–5% | by weight | sodium laureth sulfate and |
| 86–97–2% | by weight | water and providing the cleaning solution in |

sufficient volume in the exterior container to cover the fishing reel parts placed on the bottom surface of the interior container.

5. A method of cleaning rust, old grease, oil and salt particles from a fishing reel comprising (1) disassembling the fishing reel into its various parts;

(2) placing the parts on a bottom surface of an interior container having multiple holes in a bottom surface;

(3) inserting the interior container into a larger exterior container;

(4) covering the fishing reel parts with a cleaning solution consisting essentially of

| | | |
|---|---|---|
| 1–10% | by weight | 2-butoxyethanol, |
| 0.3–4% | by weight | tetra sodium salt of ethylenediamine tetra acetic acid, |
| 2.0–5% | by weight | sodium metasilicate, |
| 0.5–5% | by weight | of a surfactant and |
| 86–97.7% | by weight | water, |

(5) soaking the parts in the cleaning solution and (6) thereafter removing the interior container from the exterior container washing the reel parts in water, and allowing the parts to air dry.

* * * * *